United States Patent [19]

Chaussepied

[11] Patent Number: 4,516,686

[45] Date of Patent: May 14, 1985

[54] PRESSURE BALANCING DEVICE WHICH IS WATERTIGHT AS CONCERNS RAINWATER OR TRICKLING WATER, IN PARTICULAR FOR A TRANSPORTING CONTAINER

[75] Inventor: Jacques E. C. Chaussepied, Saint Medard en Jalles, France

[73] Assignee: Societe Nationale Industrielle Aerospatiale, France

[21] Appl. No.: 612,605

[22] Filed: May 21, 1984

[30] Foreign Application Priority Data

May 20, 1983 [FR] France ..... 83 08364

[51] Int. Cl.[3] ..... B65B 3/04; B65D 51/16

[52] U.S. Cl. ..... 220/85 R; 220/83; 220/367; 220/1.5

[58] Field of Search ..... 220/85 R, 1.5, DIG. 27, 220/367; 215/307, 308, 311

[56] References Cited

U.S. PATENT DOCUMENTS

| | | | |
|---|---|---|---|
| 2,113,454 | 4/1938 | Mitchell | 220/367 X |
| 2,939,603 | 6/1960 | Young | 220/83 X |
| 3,029,967 | 4/1962 | Morrison | 220/1.5 X |
| 3,356,249 | 12/1967 | Koester | 220/367 X |
| 3,888,382 | 6/1975 | Blumhardt | 215/307 X |
| 4,013,105 | 3/1977 | Uuskallio | 220/85 R X |

*Primary Examiner*—Steven M. Pollard

*Attorney, Agent, or Firm*—McGlew and Tuttle

[57] ABSTRACT

The device comprises a chamber 9 having an outer wall 10 and an inner wall 12 which separates it from the container, the chamber 9 communicating with the exterior through at least one orifice 16, 16*a*, 16*b*, 16*c* in the outer wall 10 and with the interior of the container through a tube 13 which extends through the inner wall 12 and projects into the chamber 9. The shape of the inner wall 12 and the position of the orifice 16, 16*a*, 16*b*, 16*c* being such that, in any position of the container, the orifice, or a part of the orifice, is located at a level lower than the level of the inner end 15 of the tube 13 so that any liquid which may be contained in the chamber cannot penetrate into the container.

16 Claims, 2 Drawing Figures

PRESSURE BALANCING DEVICE WHICH IS WATERTIGHT AS CONCERNS RAINWATER OR TRICKLING WATER, IN PARTICULAR FOR A TRANSPORTING CONTAINER

The present invention relates in a general way to containers employed for transporting fragile materials or equipment such as electronic, electromechanical, optical or other equipment used for example in the aeronautic, spacecraft, medical and other fields, and it more particularly relates to a device for balancing the internal pressure of these containers with the atmospheric pressure.

These containers must ensure an effective protection against risks of handling (blows, dropping) and must be watertight as concerns rainwater and trickling water. The last requirement implies a construction having a substantially airtight property.

This airtightness results in well-known drawbacks which are due to variations in the pressures inside and outside the container. These pressure variations may have two main causes one of which is the difference in temperature between the interior and exterior of the container which is subjected to variations in the ambient temperature while the other is due for example to variations in altitude when transporting in a aircraft or helicopter which may or may not be pressurized. Further, these two causes may be combined in some cases.

The pressure difference may reach such values that the deformations of the container might be harmful to the articles it contains.

In order to overcome these drawbacks, containers have been constructed in a sufficiently strong material, but this results in an expensive increase in weight, in particular in the case of air transport.

U.S. Pat. No. 2,113,454 discloses a free air communication valve device which automatically closes when the container is in a position other than its normal position. This device does not provide a seal against trickling water when the container is in the vertical position.

Disclosed in U.S. Pat. No. 2,939,603 is a pressure balancing device formed by a discharge valve actuated by means of a screw. This device requires tightening or untightening the screw. When the screw is tightened, it prevents the balancing of the pressure, and when it is untightened, the container is no longer sealed against rainwater or trickling water.

French Pat. No. 2,369,175 and its addition No. 2,436,718 disclose an arrangement of vacuum chambers in a container for ventilating the lateral walls. The arrangement of these chambers which include baffles does not prevent the penetration of rainwater and/or trickling water in the various positions of the container and is moreover complicated in construction and consequently expensive.

It is clear from the foregoing that the devices of the prior art do not solve both the problems concerning watertightness and those concerning pressure balancing in a satisfactory manner, although equipressure valves exist which are often complicated equipment requiring periodic maintenance in order to guarantee their good operation.

An object of the invention is to overcome these drawbacks and to provide a pressure balancing device for a container, in particular for transporting fragile articles, which permanently ensures balancing of the internal pressure of the container with the atmospheric pressure while providing at the same time an effective barrier against penetration of rainwater and/or trickling water.

Consequently, the invention provides a pressure balancing device which is watertight as concerns rainwater or trickling water for a container, said device comprising a chamber having an outer wall, and an inner wall separating the chamber from the container, said chamber communicating, on one hand, with the exterior through at least one orifice formed in said outer wall and, on the other hand, with the interior of the container through a tube which extends through said inner wall and projects into said chamber, the shape of said inner wall and the position of said orifice of the outer wall being such that, in any position of the container, the orifice, or a part of the latter, is located at a level lower than that of the end of said tube in the chamber.

In the following description, the term "orifice" is intended to mean an opening of any shape.

With this arrangement, any liquid which may have entered the chamber cannot penetrate into the container.

According to another feature of the invention, the device includes a deflecting plate spaced from said outer wall and overlapping the latter so as to form interstices arranged as baffles with the orifices.

According to a preferred embodiment of the invention, said outer wall is formed by a part of the wall of the container.

Said inner wall may have any shape. According to a preferred embodiment of the invention, it has the shape of a quarter of a cylinder. According to another embodiment, it has the shape of a quarter of a sphere.

Further features and advantages of the invention will be apparent from the following description with reference to the accompanying drawing which is given merely by way of example and in which.

Figure 1:
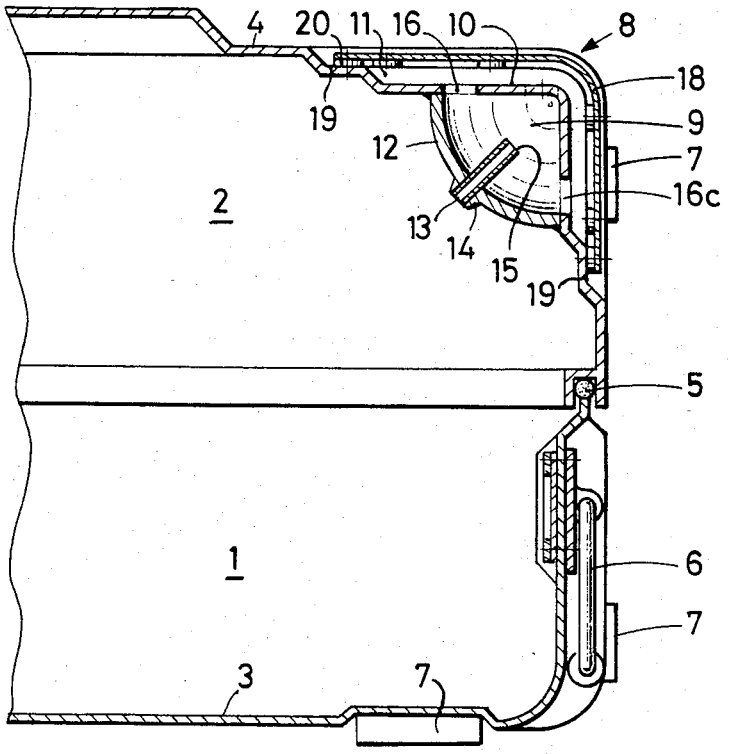
FIG. 1 is a partial sectional view of a container for transporting fragile articles by air and including a device according to the invention.

With reference of the drawing, there is shown a part of a container having a generally roughly parallel-sided shape, of known construction, made for example from resin reinforced with fibreglass, including a lower part 1 and upper part 2 which are maintained assembled by conventional means (not shown), including a bottom 3 and an upper wall 4 constituting a cover, sealing means 5 at the junction between the upper and lower parts, 1 and 2, handling and securing means 6 and feet 7, or like conventional means on transporting containers.

Figure 2:
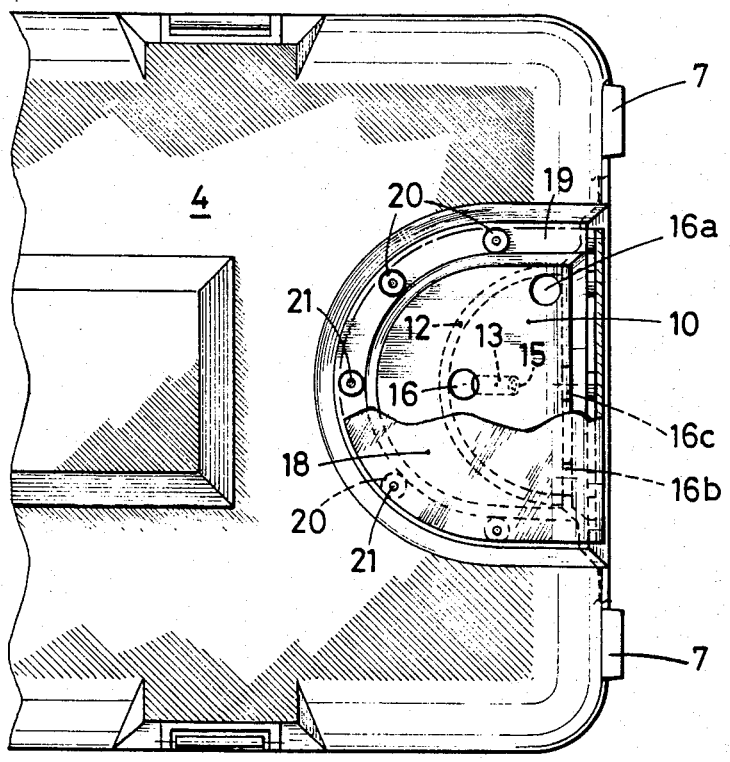
FIG. 2 is a top plan view, with a part cut away, corresponding to the view of FIG. 1.

The container shown in the drawing includes a pressure balancing device providing a watertightness as concerns rainwater and trickling water, this device being generally designated by the reference numeral 8. This device 8 comprises a chamber 9 having an outer wall formed by a part 10 of the wall of the cover 4, this part 10 being slightly set back relative to the rest of the wall of the cover and thus defining a shallow cavity 11, this part of the wall of the cover being astride two adjacent sides of the wall of the cover, on each side of the upper edge and roughly at equal distances from the two corners of the cover of the container, as shown in FIG. 2.

Chamber 9 has an attached inner wall 12 which has the shape of a quarter of a sphere in the illustrated embodiment.

The inner wall 12 partitions off the chamber 9 from the inner volume of the container and has extending therethrough radially a tube 13 which puts the inner volume of the container in communication with the inner volume of the chamber 9.

The tube 13 is fixed in a boss 14 of the wall 12 and projects into the chamber.

The outer wall 10 of the chamber 9 is provided with orifices 16, 16*a*, 16*b*, 16*c*, only two of which can be seen in FIG. 1, whereas all of them are visible in FIG. 2.

The end of the tube 15 is located:

on one hand, above the plane or planes of water which might accumulate in the chamber regardless of its position, on the other hand, at sufficient distance from the walls of the chamber to avoid penetration of liquid in said venting tube 13, due to a possible wave front of liquid.

With reference to FIG. 2, it can be seen that an orifice 16 is provided in the middle of the semi-circle formed by the wall 12, when viewed in plan, another orifice 16*a* being provided in the upper part of the outer wall 10 in the vicinity of the corner formed by the latter along the edge of the container, a third orifice 16*b* being provided in the lateral part of the outer wall 10, in diametrically opposed relation to the orifice 16*a*, while a fourth orifice 16*c* is symmetrically arranged with the orifice 16 relative to the lateral edge of the outer wall 10.

It will be understood that, owing to the shape of a quarter of a sphere of the inner wall 12 and to the position of the orifices 16, 16*a*, 16*b*, 16*c*, any liquid which is located in the chamber 9 cannot enter the container, regardless of its position. Moreover, the inner end 15 of the tube 13 in the chamber 9 is always located above one of the orifices 16, 16*a*, 16*b*, 16*c*, regardless of the position of the container. Thus it will be understood that any rainwater or trickling water which might enter the chamber 9 can never reach a sufficient level in the latter to penetrate inside the container through the end 15 of the tube 13.

In order to limit still further the possibility of penetration of rainwater or trickling water into the chamber, there is advantageously provided, in accordance with another feature of the invention, a deflecting wall 18 which overlaps the outer wall 10 while being spaced from the latter as shown in FIG. 1, this deflecting wall 18 having a generally L shape, the ends of the branches of which are rounded, this deflecting wall being fixed by the inner edge of its branches to the periphery 19 of the cavity 11 by spacer members 20, for example by rivets or spot welds 21.

It will be understood that, by means of this arrangement, the deflecting wall 18 defines with the periphery 19 of the cavity 11 formed in the upper wall 4 of the container a gap whose height corresponds to the thickness of the spacer members 20, so that there is provided a free passage for air, while the gaps between the spacer members 20 are obstructed with respect to the orifices 16, 16*a*, 16*b*, 16*c* so that rainwater or trickling water which may enter the interior of the chamber 9 is limited to the amounts which may reach the orifices 16, 16*a*, 16*b*, 16*c*, these extremely limited amounts immediately flowing through these orifices without ever reaching the level determined by the end of 15 of the tube 13.

It will, of course, be understood that the inner wall 12, which has been described as having the shape of a quarter of a sphere, could have a different shape, for example could be formed by portions of a plane which make therebetween dihedral angles for example defining a portion of a polyhedron (including a cylinder).

It will also be understood that, if desired, there may be provided a plurality of chambers 9 located in any positions of the wall of the container so that the outer wall 10 overlaps at least one edge of the container, said chambers 9 thus ensuring not only the balancing of the pressure of the container but also, in combination, a venting and/or ventilation of the interior of the container or enclosure.

It will be understood that the deflecting wall 18 constitutes a protection for the outer wall 10 of the chamber so that, in the event of a blow resulting from a brutal handling of the container, this wall 10 is protected from any risk of breakage.

The invention therefore provides a pressure-balancing device which is perfectly watertight as concerns entry of rainwater or trickling water and is particularly advantageous for use on containers transporting fragile articles which may therefore be stored in any direction without paying attention to a predetermined side for bearing on the ground and also permits the transporting of containers by air without any particular protection as concerns pressure variations. Further, the articles packed in the container provided with the device according to the invention are always protected from rainwater or trickling water, so that the container is suitable for overseas transport even outside the holds of the ship. Tests carried out with artificial rain with abundant spraying in all positions of the container have shown a perfect flow of the water in the pressure-balancing chamber 9 with no penetration of the liquid inside the container through the tube 13 occurring.

In a modification (not shown), the wall 10 could be eliminated so that the chamber 9 would be defined by the wall 12 and the deflector 18, the gap between the deflector 18 and the wall 4 divided by the spacer members 20 defining passage sections for water or air ensuring the function of the orifices formed in the wall 10 of the basic arrangement.

What is claimed is:

1. A pressure balancing device which is watertight as concerns rainwater or trickling water for combination with a transporting container for transporting for example fragile articles, said device comprising a chamber having an outer wall and an inner wall which is for separating said chamber from said container, at least one orifice in said outer wall for putting said chamber in communication with the exterior, a tube extending through said inner wall and projecting into said chamber for putting the interior of said chamber in communication with the interior of said container, said inner wall having such shape and said orifice having such position that, in any position of the container, at least a part of said orifice is located at a level lower than a level of the end of said tube in said chamber.

2. A pressure balancing device according to claim 1, comprising a deflecting plate which is spaced from said outer wall and spans said outer wall by defining therewith interstices in a baffle arrangement with said orifice.

3. A pressure balancing device according to claim 2, in combination with said chamber, wherein said outer wall is formed by a part of a wall of the container.

4. A pressure balancing device according to claim 3, wherein said tube is a venting tube for the interior of said container.

5. A pressure balancing device according to claim 3, wherein said part of the wall of the container is set back relative to the rest of said wall of the container and defines a cavity therewith.

6. A pressure balancing device according to claim 5, wherein said deflecting wall closes said cavity and is in the extension of the wall of said container.

7. A pressure balancing device according to claim 5, wherein said deflecting wall constitutes an outer wall of an assembly comprising said chamber and said cavity and defines a single space which is solely and internally defined by said inner wall.

8. A pressure balancing device according to claim 3, wherein said chamber is located in any part of at least one edge of the container so that said outer wall spans said one edge.

9. A pressure balancing device according to claim 8, wherein said inner wall of said chamber has the shape of a portion of a sphere.

10. A pressure balancing device according to claim 9, wherein said shape is a quarter of a sphere.

11. A pressure balancing device according to claim 8, wherein said inner wall of said chamber has the shape of a portion of a cylinder.

12. A pressure balancing device according to claim 11, wherein said shape is a quarter of a cylinder.

13. A pressure balancing device according to claim 8, wherein said inner wall of said chamber has the shape of a portion of a polyhedron.

14. A pressure balancing device according to claim 13, wherein said shape is a quarter of a polyhedron.

15. A pressure balancing device according to claim 1, wherein said tube projects into the interior of said chamber in such manner that the end of the tube is located:

above a plane or planes of water which might accumulate in said chamber, regardless of the position of said chamber, at sufficient distance from the walls of said chamber to avoid penetration of said water in said tube due to a possible water wave front.

16. An enclosure in combination with a pressure balancing device which is watertight as concerns rainwater or trickling water, said device comprising a chamber having an outer wall and an inner wall, which inner wall separates said chamber from the interior of said enclosure, at least one orifice in said outer wall for putting said chamber in communication with the exterior, a tube extending through said inner wall and projecting into said chamber for putting the interior of said chamber in communication with the interior of said enclosure, said inner wall having such shape and said orifice having such position that, in any position of said enclosure, at least a part of said orifice is located at a level lower than a level of the end of said tube in said chamber.

* * * * *